United States Patent [19]

Marass

[11] 3,975,011

[45] Aug. 17, 1976

[54] STACK CHANGER IN CONTINUOUSLY OPERATED SHEET FEEDING MACHINES

[75] Inventor: Josef Marass, Seehausen, Germany

[73] Assignee: Georg Spiess GmbH, Gersthofen, Germany

[22] Filed: June 11, 1975

[21] Appl. No.: 586,058

[30] Foreign Application Priority Data

Feb. 10, 1975 Germany ..... 2505530

[52] U.S. Cl. ..... 271/157

[51] Int. Cl.[2] ..... B65H 1/26

[58] Field of Search ..... 271/157–159, 271/218; 214/8.5 A

[56] References Cited

FOREIGN PATENTS OR APPLICATIONS 1,011,902 7/1957 Germany ..... 271/158

*Primary Examiner*—Evon C. Blunk
*Assistant Examiner*—Robert Saifer
*Attorney, Agent, or Firm*—Webb, Burden, Robinson & Webb

[57] ABSTRACT

An automatic adjusting device for stack changers in a sheet feeding device which compensates for the progressive drop formed on the residual stack as the auxiliary stack table is withdrawn.

1 Claim, 2 Drawing Figures

STACK CHANGER IN CONTINUOUSLY OPERATED SHEET FEEDING MACHINES

Figure 1:
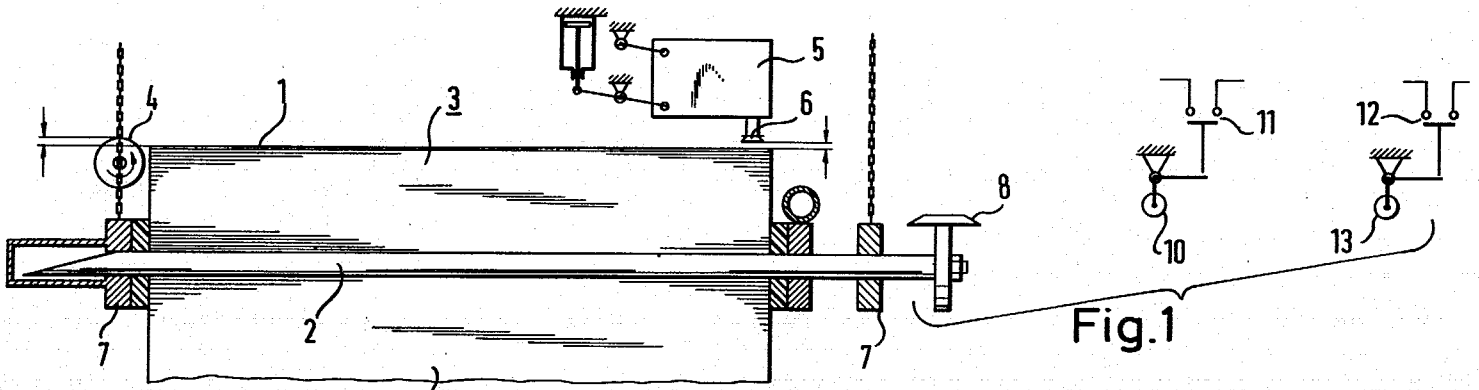

This invention relates to a device for changing stacks in continuously operating sheet feeding machines.

Generally speaking, in a device according to this invention, one stack (referred to herein as the main stack) is raised to the bottom of another stack being fed (referred to herein as the residual stack). The support for the residual stack (the auxiliary table herein) is then withdrawn and the main stack becomes the support therefor. Upon depletion, one main stack becomes the next residual stack. A system for raising the main stack to the residual stack and withdrawing the support therebetween is set forth in my copending applications filed of even date herewith entitled "Lifting Device for Sheet Feeding Machines" being application Ser. No. 586,068 and "Device for Changing Stacks in Continuously Operated Sheet Feeding Machines" being application Ser. No. 586,060.

Prior devices use an auxiliary stack table, a rake, parallel rollers, or the like. After the main stack has been brought forward and the residual stack carried by the auxiliary stack table has been largely used up, the rake or the like is withdrawn on the one side of the stack so that the bottommost sheet of the residual stack and the topmost sheet of the main stack abut against one another.

It is unavoidable that while the auxiliary stacking table is being withdrawn, there will be a drop in the sheets of the residual stack approximately equivalent to the height of this table. This drop progresses from the one side of the stack to the other as the auxiliary stack table is being withdrawn. This dropping of the sheets of the residual stack impairs the advancement of the then topmost sheet over the subsequent transfer roller and the distance between the top sheet and the separating and advancing suction apparatuses of the suction head is increased in an unreliable manner, thus leading to difficulties in operation. Up to the present time, attempts have been made to avoid these difficulties by manually imparting an impulse to the stack-advancing mechanism shortly after the withdrawal of the auxiliary stack table is begun in order to compensate for the dropping of the residual stack by a supplementary lift of the stack. But this supplementary lift would have to be only so slight that the topmost sheet in the zone of the residual stack that had not yet dropped would not get too close to the separating and advancing suckers of the suction head. In order to prevent this, the suction head was, if necessary, temporarily manually set somewhat higher and was then let down again. It is an object of the invention to avoid this complicated procedure when changing stacks and to create an automatic device for compensating for the drop that is caused on the upper side of the auxiliary stack when the auxiliary stack table is withdrawn laterally.

Briefly, according to this invention, switches are actuated as a function of the position of the auxiliary stack table at the time of the lateral withdrawal. The first of these switches closes a circuit at the time of the withdrawal or shortly after withdrawal is begun which causes a supplemental stack advancement and a corresponding raising of the suction head. A second switch closes a circuit after the auxiliary stack table has been completely withdrawn which causes the suction head to drop down to its original elevation. In this way, the proper elevation of the forward edge of the sheet relative to the other advancing means and also the normal interval relative to the suction head are guaranteed.

Thereby all the inaccuracies which occurred hitherto in manual adjustment are avoided.

Figure 2:
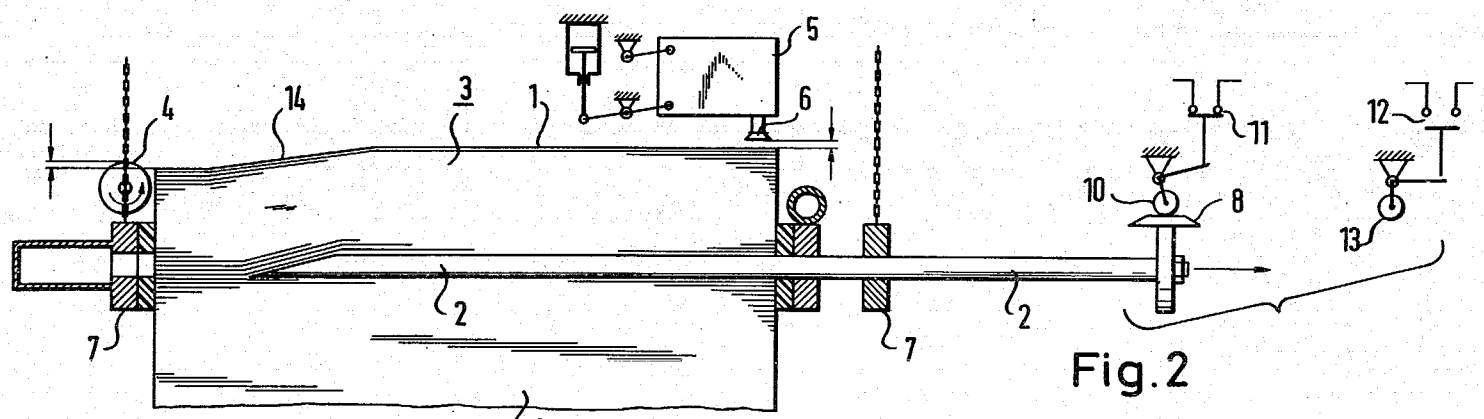

Further features and other objects and advantages will become clear from the following detailed description made with reference to the drawings in which:

FIG. 1 is a schematic side elevation of a residual stack with the auxiliary stack table which supports it, and the adjacent main stack and FIG. 2 schematically shows the auxiliary stack table in the course of being withdrawn.

In the operating stage shown in FIG. 1, the topmost sheet 1 of residual stack 3 lying on auxiliary stack table 2 is in the normal elevation relative to conveying roller 4. The suction head 5 with its suckers 6 is in the normal operating position relative to the top surface of the stack. The auxiliary stack table is designed in the form of a rake and consists of a number of parallel rods that are rigidly connected to one another at their one end. It is carried by the cross beams 7 of the stack lifting device, the said beams, for instance, being suspended on chains. The following main stack 9 is brought up to the auxiliary stack table 2.

As may be seen from FIG. 2, when the auxiliary stack table 2 is withdrawn, a drop 14 is formed on the surface of auxiliary stack 3 and progresses as withdrawal proceeds. In order to compensate for this and to bring the front side of top sheet 1 into the proper elevational position relative to conveying roller 4 regardless of the drop, a mushroom-shaped stop 8 is disposed at the end of auxiliary stack table 2 and acts upon a roller lever 10 which closes contact or switch 11 and thereby also closes a circuit which causes supplemental advancement of stack 9 and to residual stack 3. At the same time, a device effects a corresponding raising of suction head 5. Hence, the correct elevation of the front end of sheet 1 relative to conveying roller 4 is guaranteed and the normal distance between the suction head and the stack is maintained.

When the auxiliary stack table 2 has been completely withdrawn from between stack 9 and residual stack 3, stop 8 will close a second contact or switch 12 by way of roller lever 13, the said contact now closing a circuit, which once more returns the suction head 5 into its original elevation.

In continuously operating sheet feeding machines this automatic switching mechanism can be used independently of the structural design of the auxiliary stack table and its withdrawing mechanism.

Having thus described my invention with the detail and particularity as required by the patent laws, what is desired protected by Letters Patent is set forth in the following claims.

1. In a device for changing stacks in continuously operated sheet feeding machines wherein a main stack is raised to the bottom of a residual stack being fed, said residual stack supported by an auxiliary table arranged to be withdrawn on one side of the stack and wherein a progressive drop is formed on the upper side of the residual stack in the course of withdrawal of the auxiliary table, said devices having suction heads disposed over the stacks, the improvement comprising first means actuated as a function of the position of the auxiliary stack table substantially at the start of withdrawal for causing a supplemental advancement of the both stacks (9) and a corresponding raising of the suction head (5), a second means actuated after the completed withdrawal of the auxiliary stack table (2) for causing the suction head (5) to drop down to its original elevation whereby the progressive drop is compensated.

* * * * *